United States Patent [19]

Hahn

[11] 4,170,795

[45] Oct. 16, 1979

[54] PORTABLE SHOWER

[76] Inventor: Shelton T. Hahn, 3141 S. Gary, Tulsa, Okla. 74105

[21] Appl. No.: 916,842

[22] Filed: Jun. 19, 1978

[51] Int. Cl.[2] ..... A47K 3/22; A47K 3/23; A47K 3/06

[52] U.S. Cl. ..... 4/145; 4/151; 4/149; 4/153; 4/154

[58] Field of Search ..... 4/145, 146, 153, 154, 4/151, 149

[56] References Cited

U.S. PATENT DOCUMENTS

| | | | |
|---|---|---|---|
| 101,678 | 4/1870 | Taft | 4/154 |
| 202,015 | 4/1878 | Furey | 4/154 X |
| 1,049,714 | 1/1913 | Herscovitz | 4/154 |
| 1,128,662 | 2/1915 | Colter | 4/154 |
| 1,330,312 | 2/1920 | Figueroa | 4/154 X |
| 1,450,218 | 4/1923 | Nenoff | 4/154 |
| 2,852,784 | 9/1958 | Winkler | 4/154 |
| 3,606,618 | 9/1971 | Veech | 4/153 |
| 3,629,875 | 12/1971 | Dow | 4/153 X |
| 3,681,788 | 8/1972 | LaBlanc et al. | 4/153 X |

*Primary Examiner*—Henry K. Artis

*Attorney, Agent, or Firm*—Head, Johnson & Chafin

[57] ABSTRACT

A portable shower including an open top vessel having a circumferential periphery defining an area of sufficient size to accommodate a bather thereunder, the vessel having an opening and means from underneath the vessel for controlling flow of water through the opening, a shower curtain having the upper edge secured to the periphery of the vessel, and a shower bottom in the shape of a shallow flat dish having means at the periphery for attachment to the lower edge of the shower curtain so that water placed in the vessel may be discharged onto a bather concealed by the shower curtain.

3 Claims, 8 Drawing Figures

PORTABLE SHOWER

BACKGROUND AND OBJECTS OF THE INVENTION

Camping is becoming a more popular hobby as a greater percentage of the population is concentrated in cities. Many families enjoy weekend outings utilizing a tent for sleeping where they have the opportunity to fully enjoy the out-of-doors. A problem with camping is that of bathing. While some parks have shower facilities, most camping areas of the United States do not have bathing facilities. In addition, many campers prefer areas away from as many of the amenities of civilization as possible, and therefore prefer areas where public bathing facilities are not available.

The present invention is directed towards a lightweight, portable apparatus which can be collapsed into a small volume and which can be used to provide a highly convenient facility for bathing. The invention is particularly directed towards a type of shower including an open top vessel with means for supporting it at an elevated position, such as by ropes which can be attached to a tree limb. The vessels may be filled with water which, if the bather prefers, has previously been heated over a campfire. The bather may then use the portable shower for bathing in complete privacy and comfort, and after use, the device can be easily taken down and collapsed for storage and transportation.

It is therefore an object of this invention to provide an improved portable shower.

More specifically, an object of this invention is to provide a portable shower, including an open top vessel which is of design to receive a quantity of water therein, and including means of attaching a shower curtain around the vessel, means of supporting the vessel in an elevated position such as by attachment to a tree limb, and means for controlling the water discharge from the vessel onto a bather below the vessel.

These general objects as well as other and more specific objects of the invention will be fulfilled in the following description and claims, taken in conjunction with the attached drawings.

DESCRIPTION OF THE VIEWS

SUMMARY OF THE INVENTION

A portable shower is provided including an open top vessel having a circumferential periphery which defines an area of sufficient size to accommodate a bather thereunder. In the illustrated arrangement, the vessel is circular and of about 24" in diameter, although a slightly smaller or larger size is satisfactory to provide a comfortable area for a bather. The vessel has an opening in the bottom, closed by a valve, actuatable from underneath the vessel. The vessel has ropes extending upwardly therefrom so that it may be attached to the limb of a tree and as so attached, can receive water therein deposited such as from a bucket, to fill the vessel sufficient to provide water for a shower. A shower curtain is provided having the top edge affixed to the periphery of the vessel. A shower bottom in the form of a relatively flat shallow depth saucer-like element is provided on which the bather stands during a shower and includes means of attaching the lower edge of the shower curtain to the shower bottom. The complete device may be collapsed so that the total thickness is substantially that of the height of the open top vessel for ease of storage and transportation.

DETAILED DESCRIPTION

Figure 1:
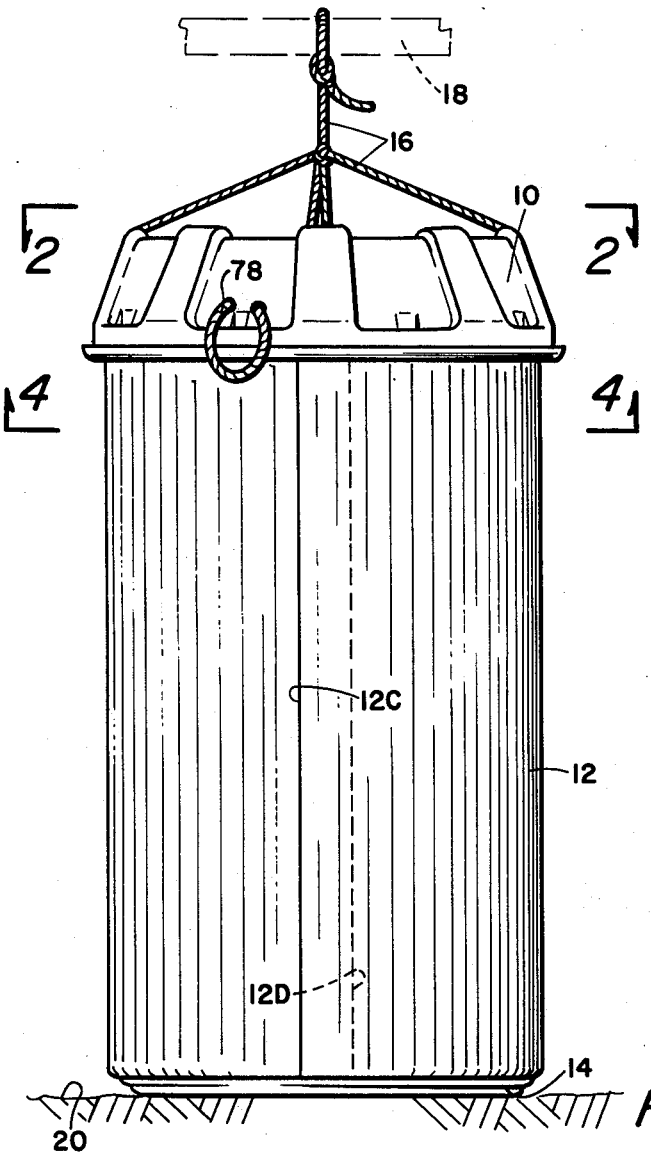
FIG. 1 is an elevational external view of an embodiment of the shower of this invention, shown supported to a tree limb.

Referring to the drawings and first to FIG. 1, an elevational view is shown of one embodiment of the portable shower of this invention. The portable shower includes an open top vessel 10, a shower curtain 12, and a shower bottom 14. The shower is supported by ropes 16 which may be tied to any elevated structure for support, such as a tree limb 18. The shower bottom 14 rests on the earth's surface 20 with the height of the vessel 10 being adjustable by the length of rope 16 so that shower curtain 12 is held more or less upright, as shown, although some slack can be employed in the shower curtain to make up for adjusting the elevation of the vessel 10 above the shower bottom 14.

Figure 2:
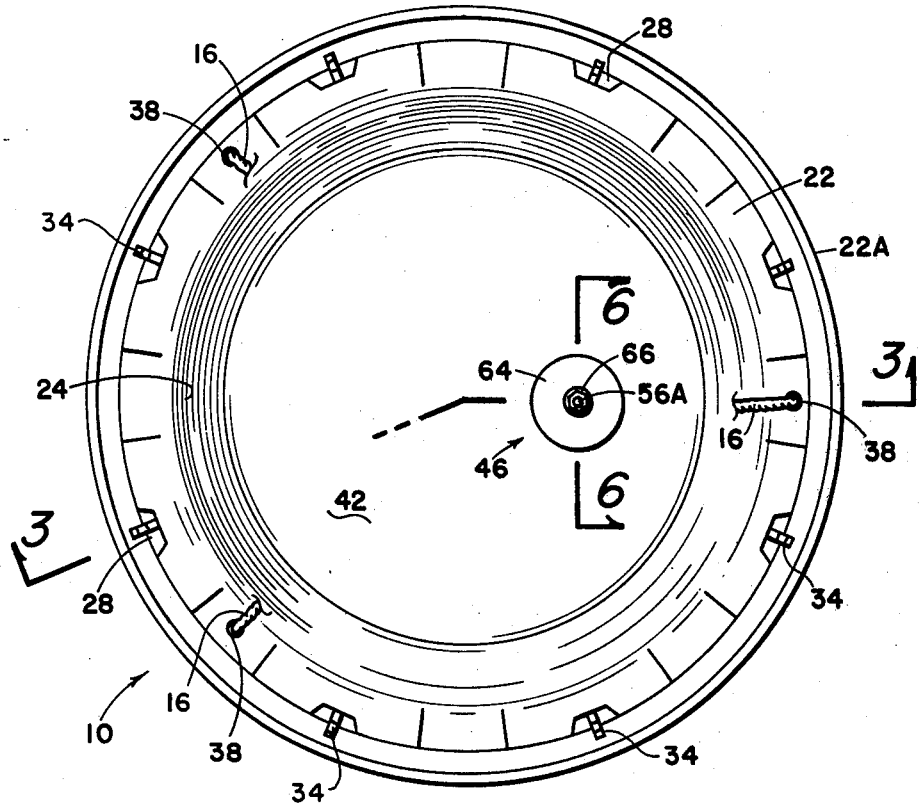
FIG. 2 is a top plan view taken along the line 2—2 of FIG. 1.
Figure 3:
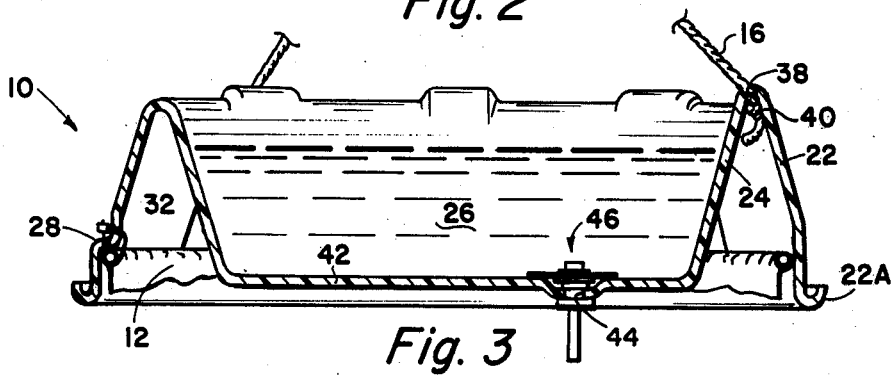
FIG. 3 is a cross-sectional view taken along the line 3—3 of FIG. 2.
Figure 5:
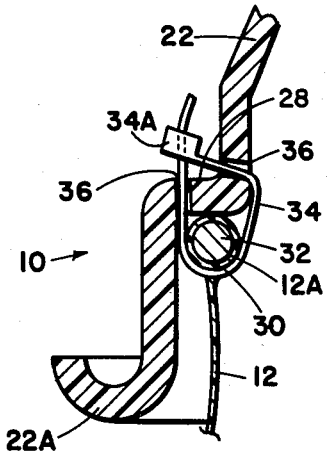
FIG. 5 is an enlarged fragmentary cross-sectional view taken along the lines 5—5 of FIG. 4 showing how the shower curtain is attached to the vessel.

Referring to FIGS. 2 and 3, the details of the vessel 10 are better shown. The vessel 10 is preferably formed of molded plastic and is open top so that water can be easily poured into it. The vessel wall is of inverted V configuration, with exterior walls 22 and interior wall 24 which receives water 26. The outer wall 22 is upturned at the lower edge 22A to provide structural rigidity. The outer wall 22 includes integral flat areas or notches 28 where means are provided for supporting the shower curtain. FIG. 5 is an enlarged cross-sectional view showing one way of supporting the shower curtain. The curtain 12 has an upper edge 30 which is formed about a circular rod 32 of metal or plastic. The rod is configured to fit against the interior surface of outer wall 22 and against notches 28 and is held in place by a plurality of straps 34 which extend through openings 36. Straps 34 may be a length of twine or small diameter rope which is tied in a knot or, as illustrated, a commercially available flat plastic strip having a self-locking outer end 34A.

Referring again to FIGS. 2 and 3, the ropes 16 by which the vessel 10 is supported consists of three or more portions which extend through openings 38 in the inverted V notch of the vessel. The lower end of each of the segments of rope 16 is tied in a knot 40, and each length of rope extends up to a center point (See FIG. 1) so that the vessel 10 is held horizontally for deposit of water therein.

The vessel interior wall 24 includes bottom 42 having an opening 44 (See FIGS. 2 and 3). A valve structure generally indicated by numeral 46 is provided to control the flow of water from the vessel and is operable from the lower surface of the vessel so that a bather may initiate or terminate the flow of water.

Figure 6:
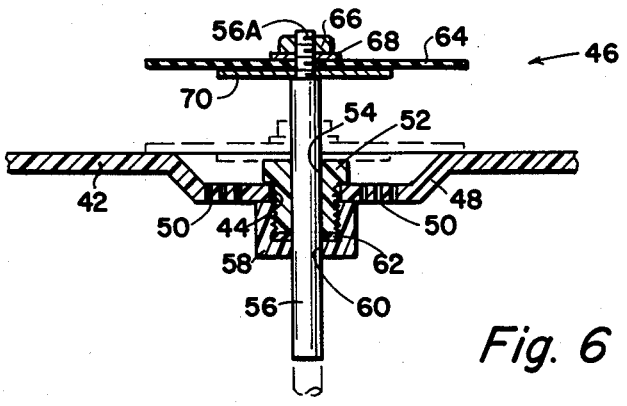
FIG. 6 is a fragmentary cross-sectional view taken along the line 6—6 of FIG. 2 showing the details of the valve used to control water flow from the vessel.

As shown in the enlarged partial cross-sectional view of FIG. 6, the vessel bottom 12 has a recessed area 48 which includes the opening 44, and surrounding that major opening, a plurality of small diameter openings 50 through which water flows when the valve is opened.

Positioned in opening 54 is an externally threaded member 52 which itself has an opening 54 receiving a shaft 56. Below the vessel bottom 42 is an internally threaded member 58 having opening 60 slidably receiving shaft 56. The externally threaded member 52 and internally threaded member 58 cooperate to close opening 44 and at the same time to receive a washer 62 therebetween which surrounds and seals the shaft 56. Thus, shaft 56 is free to be moved up and down by a bather standing beneath the vessel but water is discharged only through small diameter openings 50.

At the upper end of shaft 56 is a large diameter flexible diaphragm 64. It is attached at its center to the shaft by means of a nut 66 and small diameter washer 68 which are received about the reduced diameter threaded upper end 56A of the shaft. A lower larger diameter washer 70 supports diaphragm 64.

When the shaft 56 is pushed upwardly, water is free to flow from the interior of the vessel through small diameter openings 50. The shaft is pulled downwardly, as illustrated in dotted outline. The flexible diaphragm 56 seals against the interior of vessel bottom 42 to maintain water in the vessel. In this manner an inexpensive valve arrangement is provided completely controllable by a bather from underneath the vessel to regulate the flow of water from the vessel.

Figure 7:
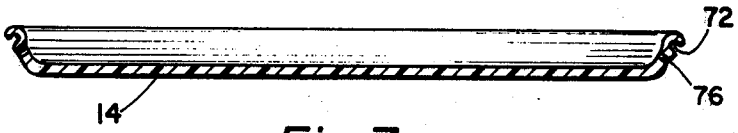
FIG. 7 is a cross-sectional view of the shower bottom showing one means of attaching the shower curtain to it.
Figure 4:
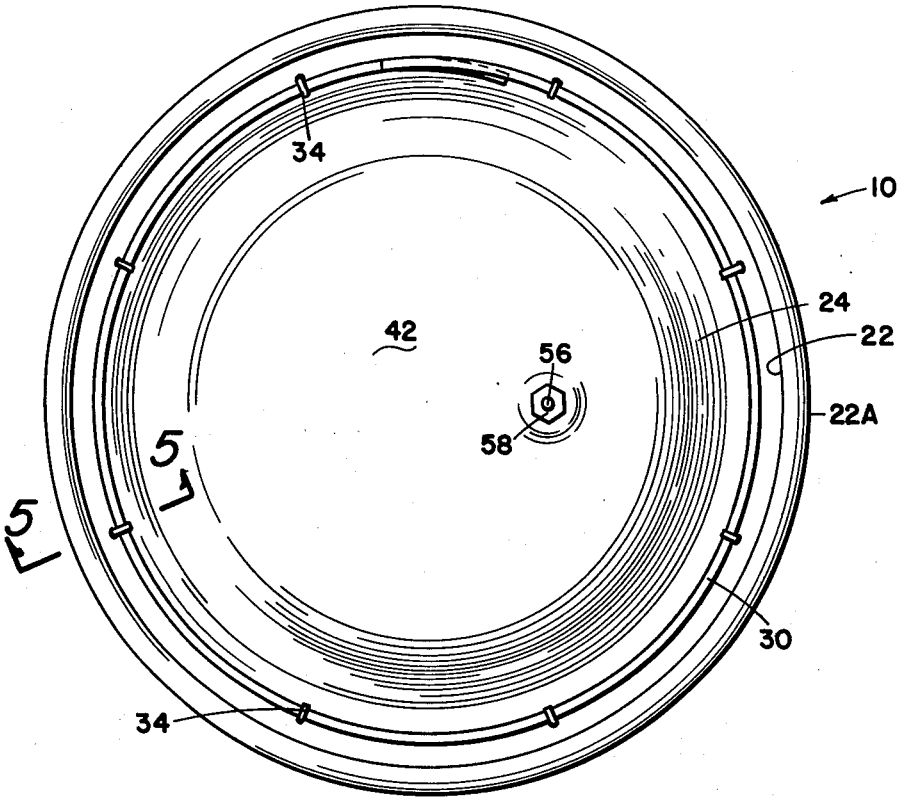
FIG. 4 is a cross-sectional view taken along the line 4—4 of FIG. 1 showing the underneath side of the vessel having the shower curtain attached to the vessel.
Figure 8:
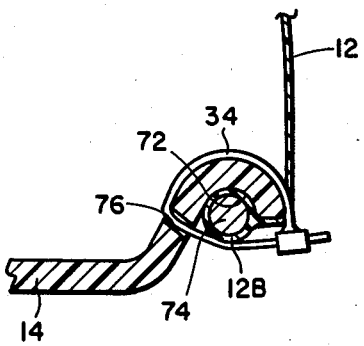
FIG. 8 is a fragmentary cross-sectional view of a portion of the shower bottom showing the manner of attachment to the lower edge of the shower curtain.

Referring to FIGS. 7 and 8, the shower bottom 14 is a shallow depth flat, saucer-shaped member preferably formed of plastic. It includes an outer circumferential recess 72 which receives the lower edge 12B of the shower curtain and a circular rod 74. A plurality of straps 34 are positioned around rod 74 and extend through openings 76. Straps 34 may be the same type illustrated and described for holding the upper end of the shower curtain.

OPERATION

When a bather desires to employ the apparatus of this invention for a shower, a tree limb or other elevated structure is located of approximately the height to 9' above the ground. By use of rope 16 the vessel 10 is supported in such a way that the shower curtain 12 hangs down and the shower bottom 14 is supported on the earth without applying stretching force on the shower curtain 12. Water is then poured in the top of the vessel with valve 46 in a closed or downward position. If the bather desires, the water can be warmed over a campfire. With the water in the vessel 10, the bather can enter the shower by separating the overlapped vertical edges 12C and 12D of the shower curtain and step onto the shower bottom 14. A short loop of rope 78 (FIG. 1) extending from vessel 10 may be used for hanging clothing and a towel outside the shower. The bather then pushes up on shaft 56, admitting water downwardly into the shower. When the shower is completed, the shaft 56 may be pulled back down to conserve water remaining in vessel 10.

Water falling down over the person taking the shower falls upon the shower bottom 14, which is not intended to be of a size to collect water of the shower but to permit the water to overflow—the function of the shower bottom 14 being to hold the shower curtain 12 in place and permit the bather to stand on a clear surface and not on the earth.

When the portable shower is to be removed, all that is necessary is that the rope 18 be taken from around the tree limb or other vertical support 18. The shower will then collapse so that all of the shower curtain 12 is packed within the inverted recess between walls 22 and 24 and the shower bottom 14 is positioned contiguous to the vessel bottom 12 providing a package of short total vertical height. Thus, the portable shower is very compact when arranged for travelling, but requires no assembly or disassembly in any way when it is put in use or removed from use.

All of the materials of which the parts of the shower of this invention are constructed can be of the non-corrosive, non-rusting and mildew-resistant type, such as various types of plastics.

While the invention has been described with a certain degree of particularity, it is manifest that many changes may be made in the details of construction and the arrangement of components without departing from the spirit and scope of this disclosure. It is understood that the invention is not limited to the embodiments set forth herein for purposes of exemplification, but is to be limited only by the scope of the attached claim or claims, including the full range of equivalency to which each element thereof is entitled.

What is claimed is:

1. A portable shower comprising:

an open top vessel having a circumferential periphery defining an area of sufficient size to accommodate a bather thereunder, the vessel having an opening therein, the vessel, in cross-section, being formed of an inner dish-shaped, substantially flat bottomed portion, and an integral downwardly extending circular flange portion, the height of the circular flange portion being substantially equal to or greater than the height of the inner dish-shaped portion, the lower, outer circumferential edge of said flange portion providing means for securing the upper edge of a shower curtain;

means of supporting said vessel in an elevated position;

means actuatable below the lower surface of said vessel of opening and closing said opening, said means including a grommet of resilient material having an opening therethrough, the grommet being received in said opening in said vessel, said vessel having a plurality of small diameter openings spaced around said grommet, a vertical shaft slidably and sealably received in said opening through said grommet, and a flap of resilient material affixed to the upper end of said shaft, the dimensions of the flap being sufficient to cover all of said openings when said shaft member is pulled downwardly, closing said openings, and when said shaft is pushed upwardly, permitting water to flow through said openings, and a shower curtain having an upper and a lower edge, the upper edge being attached to said vessel circumferential periphery whereby the shower curtain forms a tubular enclosure, and whereby water deposited in said open top vessel may be discharged through said opening to provide a shower for a bather surrounded by the shower curtain.

2. A portable shower according to claim 1 including:

a substantially flat shower bottom having a peripheral edge having means of removably receiving and retaining said lower edge of said shower curtain, whereby the shower bottom may be positioned on the ground with said vessel supported directly above to provide a complete enclosure for a bather.

3. A portable shower according to claim 1 wherein said means of supporting said vessel in an elevated position includes:

at least three ropes attached to said vessel adjacent the vessel periphery and extending upwardly for attachment to a supporting structure.

* * * * *